United States Patent [19]

Hirai

[11] Patent Number: 4,907,351

[45] Date of Patent: Mar. 13, 1990

[54] HEEL DEVICE FOR SHOES

[76] Inventor: Giichi Hirai, No. 2-6, 3-chome, Ichikawa Minami, Ichikawa-shi, Chiba,, Japan

[21] Appl. No.: 277,663

[22] Filed: Nov. 29, 1988

[51] Int. Cl.[4] ..... A43D 21/36

[52] U.S. Cl. ..... 36/42; 36/36 R

[58] Field of Search ..... 36/34 R, 35 A, 36 A, 36/36 B, 36 C, 36 R, 41, 42

[56] References Cited

U.S. PATENT DOCUMENTS

| | | | |
|---|---|---|---|
| 1,854,057 | 4/1932 | Norris | 36/42 |
| 2,263,186 | 11/1941 | Parkhurst | 36/36 R |
| 2,935,799 | 5/1960 | Ronci | 36/36 R |
| 3,041,747 | 7/1962 | Pfeil | 36/42 |
| 3,473,241 | 10/1969 | Parma | 36/42 |
| 4,729,178 | 3/1988 | Bouchet | 36/35 A |
| 4,819,344 | 4/1989 | Schüller | 36/34 R |

FOREIGN PATENT DOCUMENTS

| | | | |
|---|---|---|---|
| 1564696 | 4/1969 | France | 36/42 |

*Primary Examiner*—Werner H. Schroeder
*Assistant Examiner*—Diana L. Biefeld
*Attorney, Agent, or Firm*—Browdy and Neimark

[57] ABSTRACT

A heel device for shoes having a heel and a heel lift detachably attached to the heel. An insertion hole is formed longitudinally at the heel, and an inserting rod of the shape corresponding to that of the insertion hole is stood on the heel lift. The inserting rod is detachably inserted into the insertion hole of the heel to attach or detach the heel lift to or from the heel. The inserting rod is rigidly held by a clamping member formed of a material having expansible and contractible properties and strong frictional force.

4 Claims, 2 Drawing Sheets

HEEL DEVICE FOR SHOES

BACKGROUND OF THE INVENTION

The present invention relates to a heel device for shoes and, more particularly, to a heel device for shoes in which its heel lift is readily exchangeable in the heel of the shoes, such as male hides or female high-heeled shoes.

DESCRIPTION OF THE PRIOR ART

The bottoms of the heels for shoes, i.e., heel lifts, are readily worn to be frequently exchanged. However, the exchange of the heel lifts is difficult for an amateur, who must have the exchange of the lifts done by a professional repair worker. The repairing expense is so high so as to be uneconomical. Heretofore, there has been employed a method for securing heel lifts to the bottoms of the heels for shoes by press-fitting knurled metal rods formed by implanting the lifts to metal pipes inserted in the heels. However, since the heel lifts are connected to the heels for shoes by press-bonding by metal-to-metal the metal pipes to the metal rods in this method, special tools and experience are required to remove the heel lifts, and this is difficult for an amateur.

SUMMARY OF THE INVENTION

Accordingly, an object of the present invention is to provide a heel device for shoes in which the detaching and attaching operations of heel lifts can be readily achieved by any person.

Another object of the present invention is to provide a heel device for shoes in which heels are not possibly damaged in case of detaching and attaching heel lifts.

Still another object of the invention is to provide a heel device for shoes in which heel lifts are rigidly secured to heels in a simple structure.

Other and further objects, features and advantages of the invention will appear more fully from the following description.

DETAILED DESCRIPTION OF THE PREFERRED EMBODIMENTS

Figure 1:
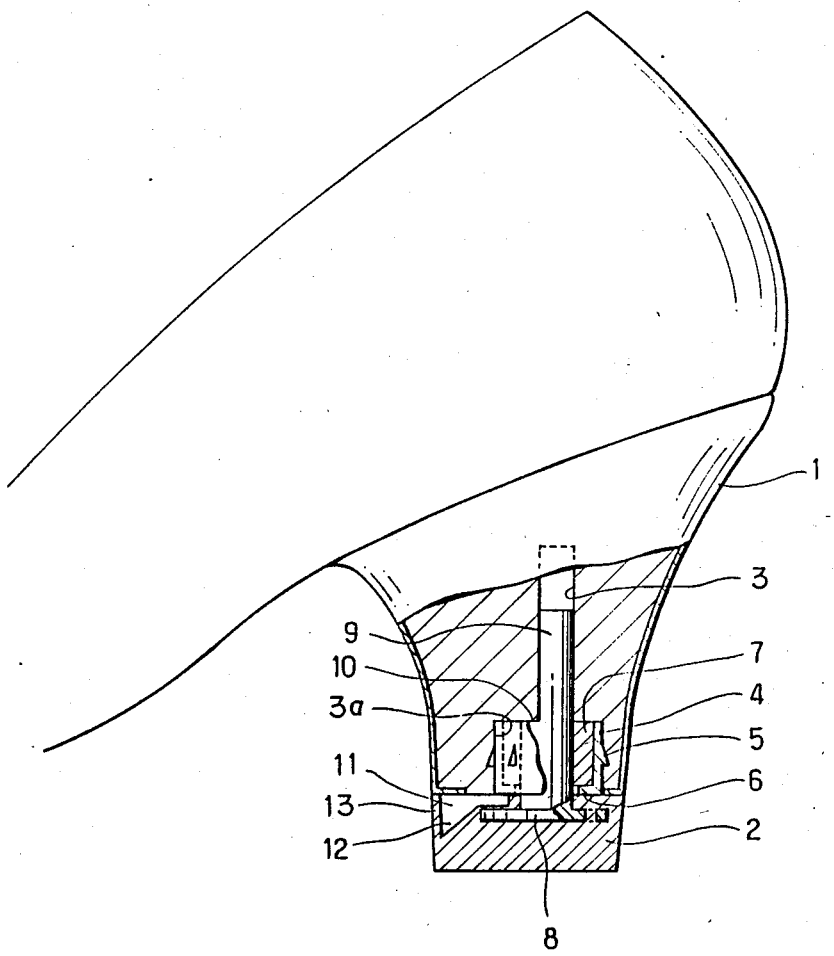
FIG. 1 is a partially sectional view of a female high-heeled shoe to which the present invention is applied.
Figure 2:
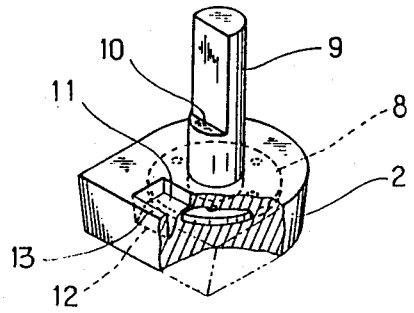
FIG. 2 is a partially sectional perspective view of the essential portion of the invention.
Figure 3:
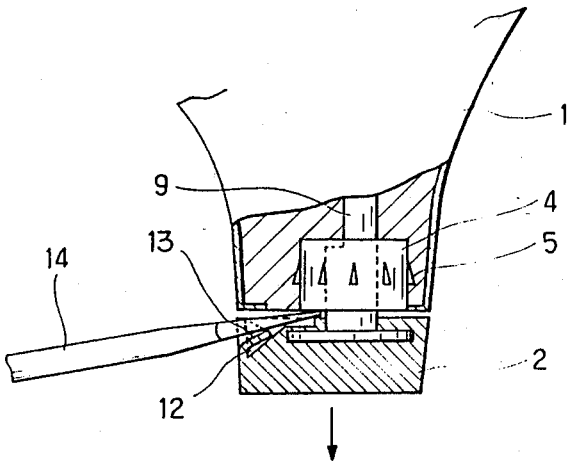
FIG. 3 is a view to show the way to remove a heel lift.

The most preferable embodiment of the present invention will be described in detail with reference to the accompanying drawings.

A heel device for shoes according to the present invention comprises a heel 1 and a heel lift 2 detachably attached to the heel 1. The heel 1 is formed of hard plastic or the like similarly to the general ones, and a slender insertion hole 3 is perforated upward from the bottom face of the heel 1. The upper portion of the insertion hole 3 is formed substantially in semicircular lateral cross-section, the lower portion is broadened in its diameter, and a metal ring 4 is ordinarily fixedly inserted thereinto. In order to permanently fix the metal ring 4 in the insertion hole 3, a number of downward pawls 5 are formed on the peripheral surface of the ring 4. Thus, the pawls 5 are intruded into the inner peripheral wall surface of the large-diameter portion 3*a* of the lower portion of the insertion hole 3. An inward flange 6 is formed at the lower end of the ring 4 to prevent a clamping member 7 of ring shape engaged in the ring 4 from dropping. The clamping member 7 is formed of synthetic resin material, such as vinyl chloride or hard rubber material having expansible or contractible properties in its diameter and strong frictional force. The ring 4 is formed on its inner surface with fine uneven surface or projections so as to increase its holding force of the clamping member 7.

On the other hand, the heel lift 2 is formed of hard plastic or hard rubber or the like. The heel lift 2 contains a disc-like metal seat 8 therein in the upper portion thereof, and an inserting rod 9 extended upward from the seat 8. The inserting rod 9 is formed in a columnar shape, and may be formed with a knurled surface thereon. The upper half portion of the inserting rod 9 is so longitudinally cut from the top thereof as to coincide with the insertion hole 3 of the heel 1 in such a manner that the lateral cross-section thereof is formed in a semicircular shape with a step 10 at the intermediate portion thereof. The height of the upper surface of the heel lift 2 (the bonding surface thereof with the bottom face of the heel 1) to the step 10 coincides with that of the ring 4, i.e., that of the lower large-diameter portion 3*a* of the insertion hole 3 of the heel 1. In order to attach the heel lift 2 to the heel 1, the lower half portion of the inserting rod 9 is press-fitted into the clamping member 7 to be rigidly held by the expansible and frictional forces of the clamping member 7 so as not to be readily removed therefrom.

A recess 11 directed from the side face toward the interior is formed on the upper front side surface of the heel lift 2. The recess 11 is formed with a deepest portion 12 at the front side thereof, retained with a thin wall 13 at the front side without opening so that the recess 11 is preferably not exposed. The thinly retained thin wall 13 is formed to be easily collapsed by a minus screwdriver 14, etc.

In the heel device constructed as described above, the heel lift 2 is exchanged when the lift 2 is progressively worn. The exchanging time can be determined when the deepest portion 12 of the recess 11 is exposed to be opened. In case of exchanging the heel lift 2, the minus screwdriver 14 or other tool is so inserted into the recess 11 as to collapse the thin wall 13, further introduced to be intruded between the lower surface of the heel 1 and the upper surface of the heel lift 2. When the screwdriver 14 is thus intruded therebetween against the clamping force of the clamping member 7 to the inserting rod 9, the inserting rod 9 is gradually removed from the insertion hole 3, and the heel lift 2 is then separated from the lower surface of the heel 1. When the heel lift 2 is separated to a predetermined degree, the heel lift 2 is manually removed, and a new heel lift 2 is instead inserted thereinto. When the new heel lift 2 cannot be manually intruded thereinto, it is hit suitably by a hammer or the like until the heel lift 2 is in close contact with the lower surface of the heel 1. Since the upper half portion of the inserting rod 9 and the insertion hole 3 are formed substantially in semicircular lateral cross sections, the heel lift 2 is not rotated with respect to the heel 1, and not necessarily positioned when the heel lift 2 is attached to the heel 1.

What is claimed is:

1. A heel device for shoes having a heel and a heel lift detachably attached to said heel comprising:

an insertion hole formed from the bottom face of said heel with a large-diameter portion formed in the lower portion thereof and a substantially lateral semicircular cross-section in the upper portion thereof of said heel, a ring engaged with the large-diameter portion of said insertion hole, a clamping member having expansible and contractible properties to be engaged within said ring and formed of a material having strong frictional force, and an inserting rod of the shape corresponding to that of said insertion hole to be inserted into said insertion hole of said heel and stood on said heel lift.

2. A heel device for shoes according to claim 1, wherein a recess is formed on the upper surface of said heel lift with a thin wall retained on the outer surface thereof.

3. A heel device for shoes according to claim 1, wherein a plurality of pawls are formed on the outer peripheral surface of said ring.

4. A heel device for shoes according to claim 2, wherein a plurality of pawls are formed on the outer peripheral surface of said ring.

* * * * *